US009193087B2

(12) United States Patent
Hasegawa et al.

(10) Patent No.: US 9,193,087 B2
(45) Date of Patent: Nov. 24, 2015

(54) CUTTER, CUTTING MEMBER AND CUTTING APPARATUS

(71) Applicants: Katsuhisa Hasegawa, Kasugai (JP); Shinya Fujihara, Obu (JP)

(72) Inventors: Katsuhisa Hasegawa, Kasugai (JP); Shinya Fujihara, Obu (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/227,957

(22) Filed: Mar. 27, 2014

(65) Prior Publication Data

US 2014/0290459 A1 Oct. 2, 2014

(30) Foreign Application Priority Data

Mar. 29, 2013 (JP) ..... 2013-071538

(51) Int. Cl.

| | |
|---|---|
| ***B41J 11/70*** | (2006.01) |
| ***B26D 7/26*** | (2006.01) |
| ***B26F 1/38*** | (2006.01) |
| ***B26D 5/06*** | (2006.01) |

(52) U.S. Cl.

CPC ..... *B26D 7/2628* (2013.01); *B26D 5/06* (2013.01); *B26D 7/2614* (2013.01); *B26F 1/3813* (2013.01); *Y10T 83/8765* (2015.04)

(58) Field of Classification Search

CPC ..... B26D 5/06; B26D 7/2628; B26D 7/2614; B26D 2007/2678; B26F 1/3813; B41J 11/706

USPC ..... 83/575, 940, 614, 370, 563, 284, 83/698.11, 582, 635, 646, 554, 633, 881, 83/856, 879, 700, 941, 880, 71, 72, 74; 408/13

See application file for complete search history.

(56) References Cited

U.S. PATENT DOCUMENTS

| | | | | |
|---|---|---|---|---|
| 3,760,997 | A * | 9/1973 | Bier | 225/2 |
| 4,392,404 | A * | 7/1983 | Schwarzenberg et al. | 83/886 |
| 4,624,169 | A * | 11/1986 | Nelson | 83/881 |
| 5,094,134 | A * | 3/1992 | Mizukoshi | 83/698.21 |
| 5,438,896 | A * | 8/1995 | Carroll | 83/76.1 |
| 5,713,656 | A * | 2/1998 | Lin | 362/120 |
| 7,882,769 | B2 * | 2/2011 | Lin | 81/177.1 |
| 2005/0045005 | A1 * | 3/2005 | Hamilton et al. | 83/13 |

(Continued)

FOREIGN PATENT DOCUMENTS

| | | |
|---|---|---|
| JP | H02-78171 U | 6/1990 |
| JP | H04152092 A | 5/1992 |

(Continued)

*Primary Examiner* — Ghassem Alie

(74) *Attorney, Agent, or Firm* — Fox Rothschild LLP

(57) ABSTRACT

A cutter, detachably attachable to a support member, includes a shaft made of a resin and has a smaller-diameter portion and a larger-diameter portion formed integrally with the shaft. The smaller-diameter portion is rotatably supported by a plurality of bearings. The larger-diameter portion has a proximal end surface abutting on an end surface of one of the bearings, with a result that the cutter is locked. The cutter includes a flat blade located on a distal end of the larger-diameter portion. The cutter includes a metal member which can be attracted by a magnet located on the support member. The metal member is located on a distal end of the smaller-diameter portion. Contact portions are located on axially differing portions of the shaft respectively and are capable of contacting the bearings respectively. Thinned parts are located between the contact portions and extend in the axial direction of the shaft.

15 Claims, 9 Drawing Sheets

(56) References Cited

U.S. PATENT DOCUMENTS

| | | | | |
|---|---|---|---|---|
| 2007/0012152 | A1* | 1/2007 | Workman et al. | 83/614 |
| 2009/0308219 | A1* | 12/2009 | Yamamoto et al. | 83/880 |
| 2014/0165808 | A1 | 6/2014 | Fujihara | |

FOREIGN PATENT DOCUMENTS

| | | | |
|---|---|---|---|
| JP | H05-25575 | U | 6/1993 |
| JP | 2014-117772 | A | 6/2014 |

* cited by examiner

CUTTER, CUTTING MEMBER AND CUTTING APPARATUS

CROSS-REFERENCE TO RELATED APPLICATIONS

This application is based upon and claims the benefit of priority from the prior Japanese Patent Application No. 2013-071538 filed on Mar. 29, 2013, the entire contents of which are incorporated herein by reference.

BACKGROUND

1. Technical Field

The present disclosure relates to a cutter capable of cutting a sheet-shaped object, a cutting member including the cutter and a cutting apparatus to which the cutting member is detachably attachable.

2. Related Art

A cutting apparatus, such as a cutting plotter, has been conventionally known which automatically cuts a sheet-shaped object. The cutting plotter includes a cutting pen which is used to cut the object. The cutting pen includes a cutting pen holder on which is rotatably held a cutter part having a cutting blade. The cutter part is formed of a bar material made of a metal such as carbon steel. The cutter part is an article of consumption. Accordingly, the cutter part is attracted to cutting pen holder by magnetic force thereby to be attached thereto and is accordingly replaceable easily. However, the cutter part has conventionally been manufactured by cutting a metal bar material. This increases manufacturing costs.

SUMMARY

Therefore, an object of the disclosure is to provide a cutter which can be manufactured at lower costs, a cutting member including the cutter and a cutting apparatus to which the cutting member is detachably attachable.

The present disclosure provides a cutter which is detachably attachable to a support member, the cutter including a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by a plurality of bearings bearing provided on the support member, the larger-diameter portion having a proximal end surface abutting on an end surface of one of the bearings, with a result that the cutter is locked in a state where an axial position of the cutter relative to the support member is immovable. The cutter further includes a flat blade provided on a first end which is a distal end of the larger-diameter portion, the flat blade cutting an object to be cut, a metal member which can be attracted by a magnet provided on the support member, the metal member being provided on a second end which is a distal end of the smaller-diameter portion, a plurality of contact portions provided on axially differing portions of the shaft respectively, the contact portions being capable of contacting the bearings respectively, and a plurality of thinned parts provided between the contact portions and extending in the axial direction of the shaft.

The disclosure also provides a cutting member includes a support member to which a cutter is detachably attached, thereby supporting the cutter, the support member having a plurality of bearings rotatably supporting the cutter and a magnet configured to position the cutter. The cutter includes a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by the bearings provided on the support member, the larger-diameter portion having a proximal end surface abutting on an end surface of one of the bearings, with a result that the cutter is locked in a state where an axial position of the cutter relative to the support member is immovable. The cutter further includes a flat blade provided on a first end which is a distal end of the larger-diameter portion, the flat blade cutting an object to be cut, a metal member which can be attracted by the magnet provided on the support member, the metal member being provided on a second end which is a distal end of the smaller-diameter portion, a plurality of contact portions provided on axially differing portions of the shaft respectively, the contact portions being capable of contacting the bearings respectively, and a plurality of thinned parts provided between the contact portions and extending in the axial direction of the shaft.

The disclosure further provides a cutting apparatus comprising an object transfer mechanism configured to transfer a holding member holding an object to be cut, a cutter moving mechanism configured to move a cutting head provided with a holder in a direction intersecting a direction in which the holding member is transferred, and a cutting member attached to the holder. The cutting member includes a support member to which a cutter is detachably attached, thereby supporting the cutter, the support member having a plurality of bearings rotatably supporting the cutter and a magnet configured to position the cutter. The cutter includes a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by the bearings provided on the support member, the larger-diameter portion having a proximal end surface abutting on an end surface of one of the bearings, with a result that the cutter is locked in a state where an axial position of the cutter relative to the support member is immovable. The cutter further includes a flat blade provided on a first end which is a distal end of the larger-diameter portion, the flat blade cutting an object to be cut, and a metal member which can be attracted by the magnet provided on the support member, the metal member being provided on a second end which is a distal end of the smaller-diameter portion, a plurality of contact portions provided on axially differing portions of the shaft respectively, the contact portions being capable of contacting the bearings respectively, and a plurality of thinned parts provided between the contact portions and extending in the axial direction of the shaft.

DETAILED DESCRIPTION

One example including a cutter, a cutting member and a cutting apparatus will be described with reference to the accompanying drawings.

Construction of a Cutting Apparatus 100

Figure 1:
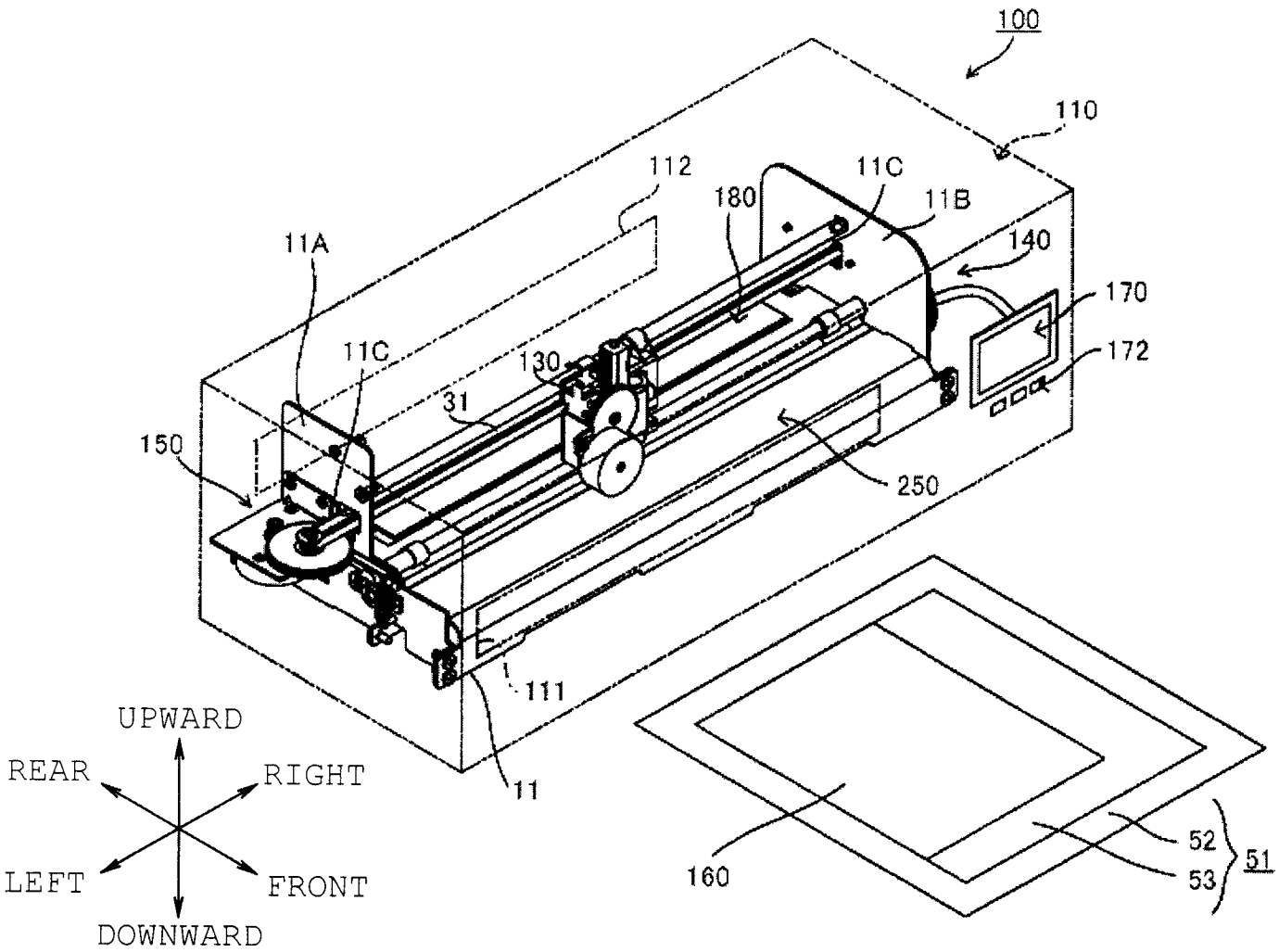
FIG. 1 is a perspective view of a cutting apparatus according to one example.

The construction of the cutting apparatus 100 will be described with reference to FIG. 1. The cutting apparatus 100 is configured to cut an object 160 and includes a housing 110, a platen 250, a machine frame 11, a cutting head 130, a transfer mechanism 140, a cutter moving mechanism 150, a display 170, switches 172 and a scanner 180.

Defining the directions, a transferring direction of the transfer mechanism 140 is referred to as "front-rear direction (Y-direction)." A moving direction of the cutter moving mechanism. 150 is referred to as "right-left direction (X-direction)." A direction perpendicular to the front-rear direction and the right-left direction is referred to as "up-down direction (Z-direction)."

The housing 110 encloses the transfer mechanism 140, the platen 250 and the cutting head 130. The housing 110 is formed into the shape of a box elongated in the right-left direction. The housing 110 has a front formed with an insertion hole 111 and a rear formed with a rear hole 112. The insertion hole 111 extends in the right-left direction. A holding member 51 is to be inserted into the insertion hole 111.

The machine frame 11 is mounted on the housing 110. The machine frame 11 includes two sidewalls 11B and 11A located at right and left sides of the platen 250 respectively. The sidewalls 11A and 11B have respective surfaces facing each other. The sidewalls 11A and 11B have openings 11C through which a timing belt 31 passes, respectively. Each opening 11C is formed into a square shape. The timing belt 31 will be described later.

The holding member 51 holding the object 160 is inserted through the insertion hole 111 and then transferred along a transfer path extending from the insertion hole 111 to the rear hole 112. The transfer path is provided along a flat surface of the platen 250 over the platen. The transfer mechanism 140 is configured to transfer the holding member 51 placed on the platen 250 in the front-rear direction. The holding member 51 will be described in detail later.

The display 170 and the switches 172 are mounted on a right-hand part of the front of the housing 110. The display 170 is a full-color liquid crystal display, for example. The switches 172 are operated by a user. The operation may include various instructions, selection and input. The switches 172 include a touch panel mounted on the surface of the display 170. The display 170 is configured to display a plurality of types of patterns, messages to be informed of the user, and the like. The user operates the switches 172 to select a pattern displayed on the display 170, to set various parameters, to instruct functions and the like.

The Holding Member 51

The holding member 51 will foe described with reference to FIG. 1. The holding member 51 is configured to hold the object 160 which is paper, cloth or the like. The object 160 is formed into the shape of sheet. The holding member 51 is formed into the shape of a rectangular flat plate. The holding member 51 holding the object 160 is inserted through the insertion hole 111 of the housing 110 to be placed on the platen 250. The holding member 51 includes a base 52 and a holding portion 53. The base 52 is made of synthetic resin. However, the base 52 may be formed of pasteboard or metal plate, instead. The holding portion 53 is disposed on the surface of the base 52. The holding portion 53 is configured to removably hold the predetermined object 160. The holding portion 53 is located in a generally rectangular inside region of the upper surface of the base 52. The holding portion 53 is an adhesive layer, for example. The object 160 is affixed to the adhesive layer thereby to be held by the holding member 51.

The Transfer Mechanism 140

Figure 2:
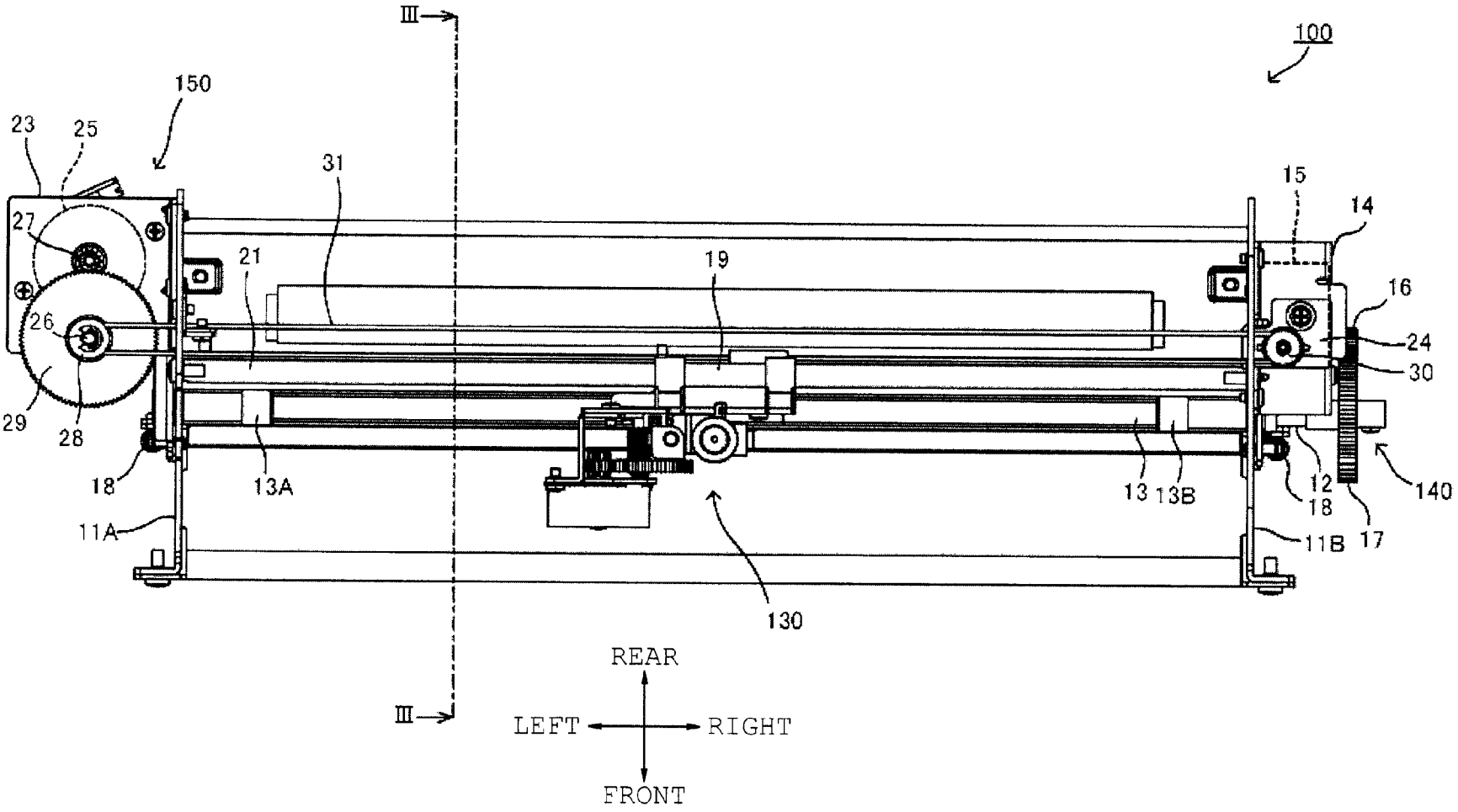
FIG. 2 is a plan view of the cutting apparatus.

The transfer mechanism 140 will be described in detail with reference to FIG. 2. The transfer mechanism 140 includes a driving roller 12, a pinch roller 13, amounting frame 14, a Y-axis motor 15, a driving gear 16, a driven gear 17 and a pair of coil springs 18. The driving roller 12 and the pinch roller 13 are disposed between the right and left sidewalls 11B and 11A so as to extend in the right-left direction.

The sidewalls 11A and 11B support both ends of the driving roller 12 so that the driving roller 12 is rotatable. The driven gear 17 is secured to the right end of the driving roller 12. The mounting frame 14 is mounted on an outer surface of the right sidewall 11B. The Y-axis motor 15 is mounted on the mounting frame 14. The Y-axis motor 15 may comprise a stepping motor, for example. The driven gear 17 is brought into mesh engagement with the driving gear 16. The driving gear 16 has a smaller diameter than the driven gear 17. The driving gear 16 is fixed to an output shaft of the Y-axis motor 15. Upon rotation of the Y-axis motor 15, its rotational driving force is transmitted via the driving gear 16 and the driven gear 17 to the driving roller 12, whereby the driving roller 12 is rotated by the Y-axis motor 15.

The pinch roller 13 has right and left ends supported by the sidewalls 11B and 11A so as to be rotatable and so as to be slightly displaceable in the up-down direction, namely, in the thicknesswise direction of the object 160. The pinch roller 13 is normally biased downward at the outer surface sides of the sidewalls 11A and 11B by the coil springs 18. The coil springs 18 are disposed between both ends of the pinch roller 13 and the sidewalls 11A and 11B respectively. The pinch roller 13 includes two roller portions 13A and 13B disposed at both ends thereof respectively. The roller portions 13A and 13B have larger respective diameters than the pinch roller 13.

The holding member 51 has right and left edges which are held between the driving roller 12 and the roller portions 13A and 13B respectively. When the driving roller 12 is rotated by the drive of the Y-axis motor 15, the holding member 51 is transferred in the front-rear direction by the transfer mechanism 140 while the edges of the holding member 51 are held between the driving roller 12 and roller portions 13A respectively.

The Cutter Moving Mechanism 150

The cutter moving mechanism 150 will be described in detail with reference to FIG. 2. The cutter mechanism 150 is configured to move the cutting head 130 in the right-left direction intersecting the direction in which the holding member 51 is transferred. The cutter moving mechanism 150 includes a guide shaft 21, a mounting plate 23, an auxiliary mounting plate 24, an X-axis motor 25, a pulley shaft 26, a driving gear 27, a left timing pulley 28, a driven gear 29, a right timing pulley 30, an endless timing belt 31 and a mounting portion 32. The guide shaft 21 is disposed so as to extend in the right-left direction between the right and left sidewalls 11B and 11A and so as to be located above the pinch roller 13 in the rear of the pinch roller 13. The cutting head 130 is moved along the guide shaft 21 in the right-left direction.

The mounting plate 23 is mounted on a rear part of the outer surface of the left sidewall 11A. The auxiliary mounting plate 24 is mounted on the outer surface of the right sidewall 118. The X-axis motor 25 is mounted on a rear part of the mounting plate 23. The pulley shaft 26 is rotatably mounted on a front part of the X-axis motor 25 and extends in the up-down direction. The driving gear 27 is fixed to an output shaft of the X-axis motor 25. The left timing pulley 28 and the driven gear 29 are rotatably supported, by the pulley shaft 26. The left timing pulley 23 and the driven gear 29 are formed integrally with each other, thereby being rotated together. The driven gear 29 is brought into mesh engagement with the driving gear 27.

Figure 3:
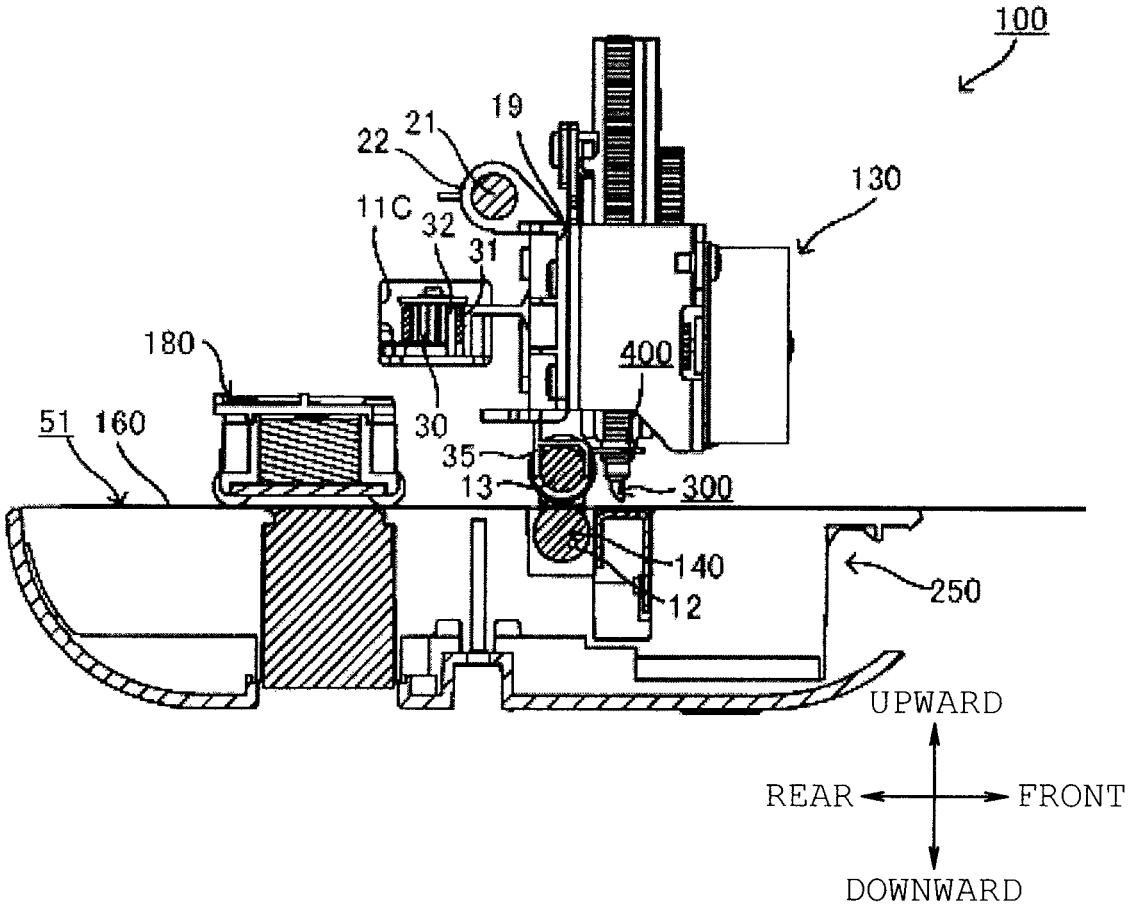
FIG. 3 is a longitudinally sectional left side view taken along line III-III in FIG. 2.

The right timing pulley 30 is rotatably mounted on the auxiliary mounting plate 24. The endless timing belt 31 extends between the right and left timing pulleys 30 and 28 horizontally in the right-left direction. The timing belt 31 includes a midway part coupled to the mounting portion 32 as shown in FIG. 3. The mounting portion 32 is disposed on the rear of the carriage 19 and caused to protrude rearward with respect to the carriage 19 to be coupled to the timing belt 31. Upon rotation of the X-axis motor 25, the rotational driving force thereof is transmitted via the driving gear 27, the driven gear 29 and the left timing pulley 28 to the timing belt 31. As a result, the carriage 19 is moved in the right-left direction by the X-axis motor 25.

The Scanner 180

The scanner 180 will be described in detail with reference to FIG. 3. The scanner 180 is configured to read an image of the surface of the object 160 transferred by the transfer mechanism 140. The cutting apparatus 100 is configured to generate cutting data based on the image of the surface of the object 160 read by the scanner 180. The cutting data is used to cut the object 160.

The Platen 250

The platen 250 will now be described in detail with reference to FIG. 3. The platen 250 is located opposite the scanner 180 with the transfer path being interposed therebetween. The platen 250 has a flat surface on which the holding member 51 holding the object 160 is placeable. The platen 250 receives the underside of the holding member 51 when the cutting apparatus 100 cuts the object 160. The platen 250 is mounted on the machine frame 11 and has a horizontal upper surface. The driving roller 12 and the pinch roller 13 are disposed substantially on the center of the platen 250 with respect to the front-rear direction. The driving roller 12 is disposed under the pinch roller 13. The driving roller 12 has an upper end substantially flush with the upper surface of the platen 250. The holding member 51 is transferred while being placed on the platen 250 with the object 160 being held on the holding member 51.

The Cutting Head 130

Figure 4:
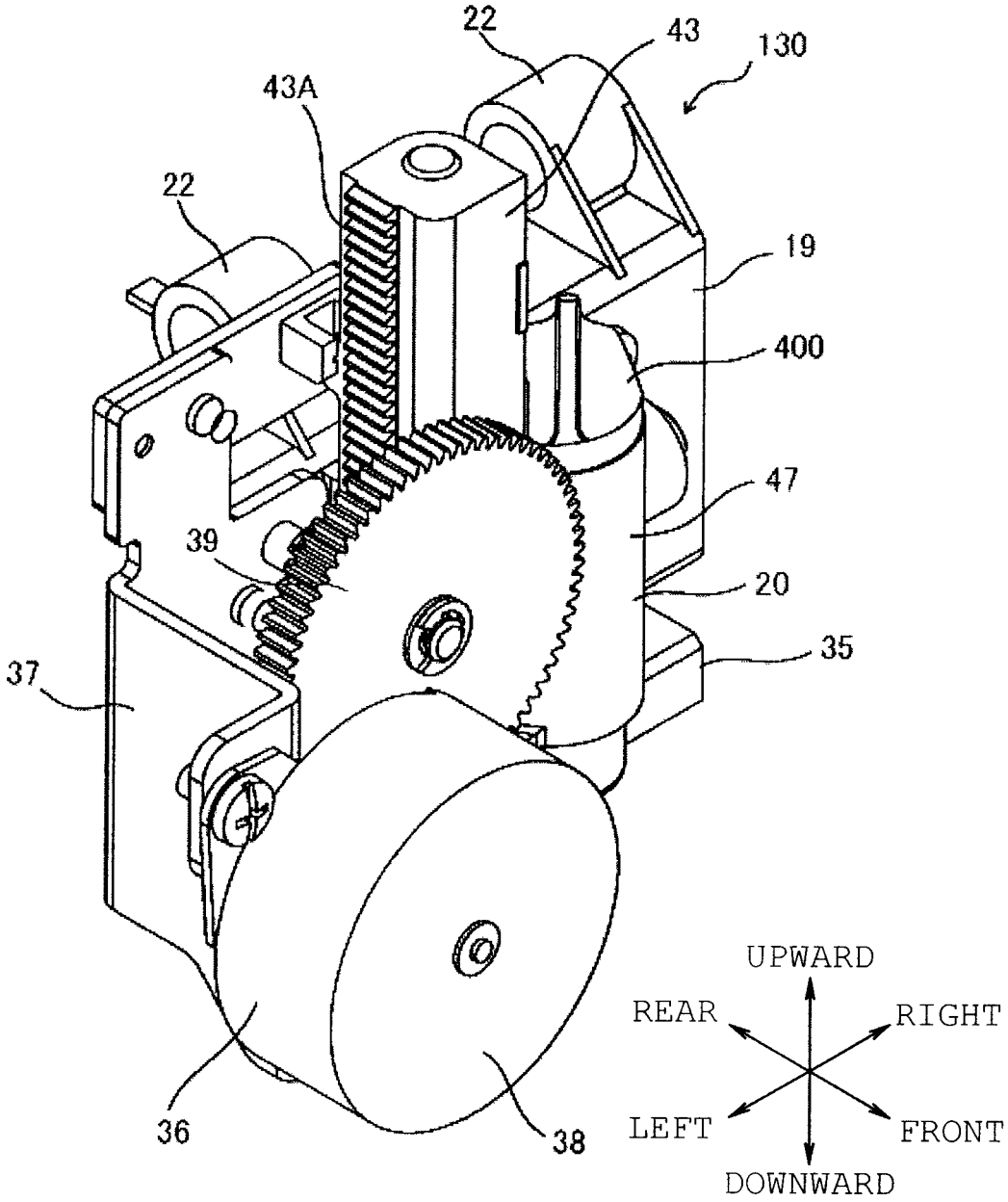
FIG. 4 is a perspective view of a cutting head.

The cutting head 130 will be described in detail with reference to FIGS. 3 and 4. The cutting head 130 includes the carriage 19, a cutter holder 20 and an up-down moving mechanism 36. The carriage 19 constitutes a rear part of the cutting head 130, and the up-down moving mechanism 36 constitutes a left part of the cutting head 130. The cutter holder 20 constitutes a right part of the cutting head 130. The carriage 10 includes two guide cylinders 22 and a sliding contact 35. The guide cylinders 22 are disposed at both sides of the carriage 19 in the right-left direction. The guide shaft 21 is inserted through the guide cylinders 22. The sliding contact 35 is downwardly open and is formed so as to have a generally U-shaped section. The sliding contact 35 is further formed into the shape of a thin plate extending in the right-left direction. The sliding contact 35 has an inner surface which is brought into sliding contact with the pinch roller shaft 13. The pinch roller shaft 13 is supported so as to be displaceable in a direction of thickness of the object 160. Accordingly, the sliding contact 35 slidingly contacts with the pinch roller shaft 13 so as to be movable relatively along the direction of displacement of the pinch roller shaft 13. The sliding contact 35 is formed into such a shape as to pinch the pinch roller shaft 13 in the front-rear direction. The sliding contact 35 is moved along a part of the pinch roller shaft 13 defined between rollers 13A and 13B mounted on the roller shaft 13. The sliding contact 35 is mounted on a lower end of the carriage 19 and maintains the position of the cutting head 130.

The cutter holder 20 includes a mounting cylinder 47 which is formed into a cylindrical shape and extends in the up-down direction. A cutting member 400 is detachably attached to the mounting cylinder 47 by screws (not shown). The cutting member 400 includes a cutter 300 as shown in FIG. 3.

The up-down drive mechanism 36 includes a mounting plate 37, a Z-axis motor 38, an intermediate gear 39 and a rack member 43. The mounting plate 37 is provided at the left side of the front of the carriage 19 and formed into a crank shape. The Z-axis motor 38 is mounted on the left, end front of the carriage 19 and may be a stepping motor 38, for example. The Z-axis motor 38 has an output shaft to which a driving gear (not shown) is fixed. This driving gear is brought into mesh engagement with the intermediate gear 39. The intermediate gear 39 is rotatably supported on the mounting plate 37. A smaller gear (not shown) having a smaller diameter than the intermediate gear 39 is coaxially formed on the intermediate gear 39. The intermediate gear 39 and the smaller gear are rotated together. The rack member 47 is provided on the left side of the mounting cylinder 47, extending in the up-down direction. The rack member 43 includes a rack portion 43A formed on a left wall of the rack member 43 and extending in the up-down direction. The rack portion 43A is brought into mesh engagement with the smaller gear.

Upon drive of the Z-axis motor 38, the driving gear is rotated, whereby the intermediate gear 35 and the smaller gear are rotated with the result that the rack member 43 is moved in the up-down direction. As a result, the cutter holder 20 is moved upward or downward. More specifically, the cutter holder 20 is moved between a raised position where the blade edge of the cutter 300 is spaced from the object 160 by a predetermined distance and a lowered position where the blade edge of the cutter 300 penetrates through the object 160.

When the cutter holder 20 is lowered by the up-down drive mechanism 36, the blade edge of the cutter 300 abuts against the object 160. While the blade edge is in abutment with the object 160, the holding member 51 is moved freely in the front-rear direction by the transfer mechanism 140, and the cutting head 130 is moved freely in the right-left direction by the cutter moving mechanism 150. As a result, the object 160 is cut by the cutter 300.

The Cutting Member 400

Figure 5:
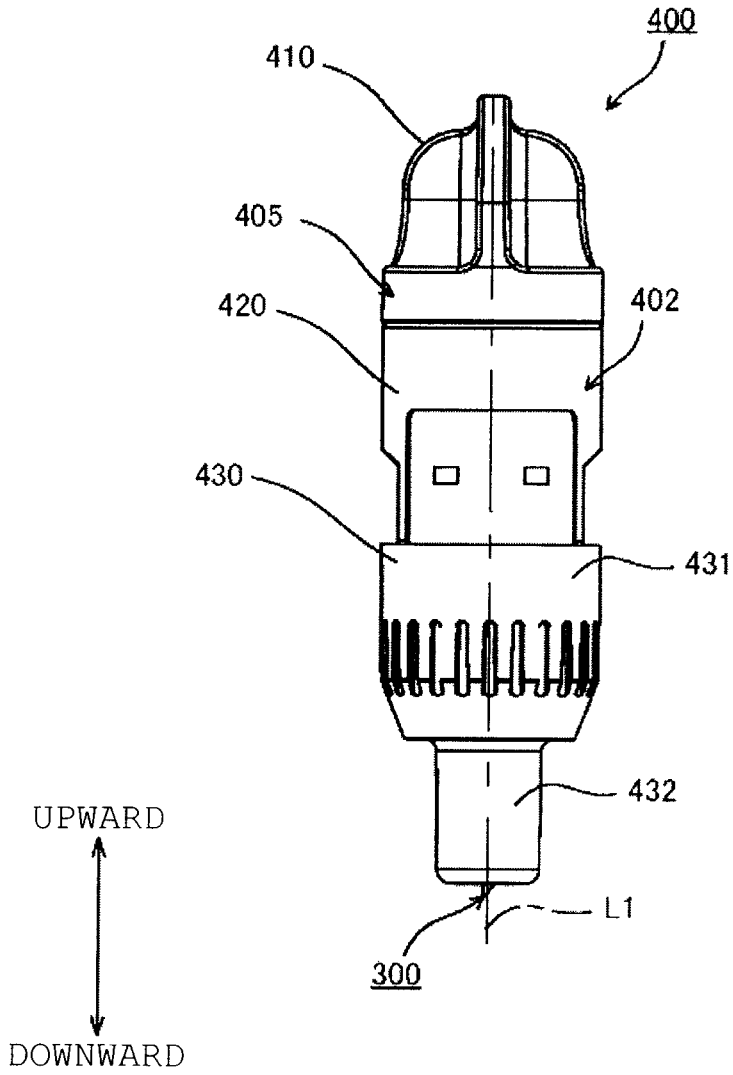
FIG. 5 is a front view of cutting member.

An external construction of the cutting member 400 will be described with reference to FIG. 5. The cutting member 400 includes a supporting member 402 which supports the cutter 300. The supporting member 402 includes an enclosure case 405. The enclosure case 405 includes a case body 420, a cap 430 provided on one end of the case body 420 and a knob 410 provided on the other end of the case body 420. The enclosure case 405 is formed of a resin material and extends in the up-down direction. The case body 420 has a stepped portion 495 at the lower side. As a result, the case body 420 has a lower portion with a smaller diameter and is formed into a stepped cylindrical shape.

The cap 430 includes a larger-diameter portion 431 and a smaller-diameter portion 432 both corresponding to the stepped portion 405 of the case body 420. The cap 430 is formed into a stepped bottomed cylindrical receptacle. The larger-diameter portion 431 has an outer circumferential surface formed with a plurality of narrow grooves at regular intervals. The grooves are formed in a lower part of the larger-diameter portion 431 than a central part in the up-down direction so as to extend in the up-down direction. The grooves serves as a slip-proof in the case where the user grip pinches the cap 430 with his/her fingers to rotate the cap 430.

Figure 6:
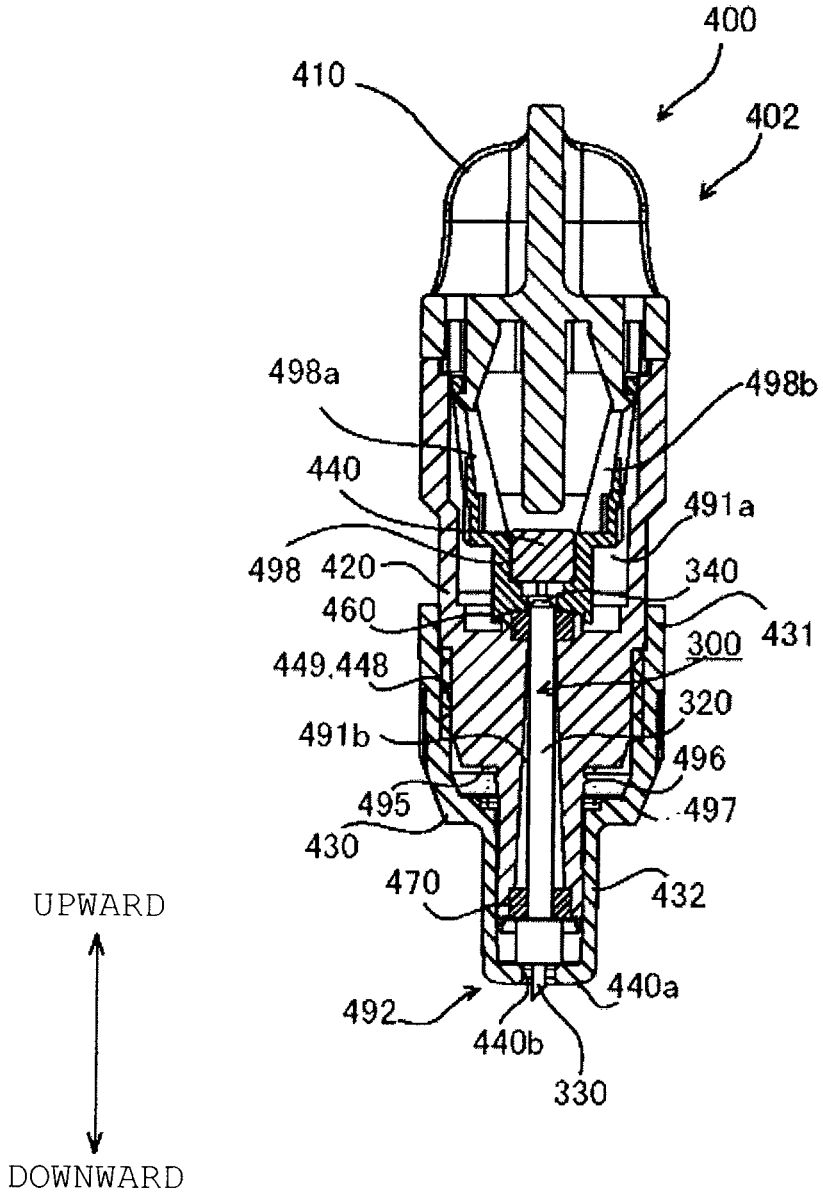
FIG. 6 is a sectional view of the cutting member.

An inner structure of the cutting member 400 will be described with reference to FIG. 6. Two storage spaces 491*a* and 491*b* are defined in the supporting member 402. A mounting member 498 is stored in the storage space 491*a*, and the cutter 300 is stored in the storage space 491*b*. More specifically, the storage spaces 491*a* and 491*b* are defined in case body 420. The storage space 491*a* is located in an upper half of the cutting member 400, and the storage space 491*b* is located in a lower half of the cutting member 400. The storage spaces 491*a* and 491*b* communicate with each other. The storage space 491*b* is defined as a recess into which a shaft 320 of the cutter 300 and a metal member 340 are insertable. The storage space 491*b* has an inner diameter substantially equal to an outer diameter of the shaft 320 of the cutter 300.

The storage space has an upper end and a lower end provided with bearings 460 and 470 respectively. The bearing 470 may be a rolling bearing such as a ball bearing. The bearing 460 may be a sliding bearing comprising a metal alloy, for example. The bearing 460 is disposed in an inner side of the storage space 491*b* spaced away from a blade 330 of the cutter 300. The bearing 470 is disposed in the front side of the storage space 491*b* near the blade 330, supporting the shaft 320. The cutter 300 has an axial length (namely, a length of the shaft 320 in the direction of the axis 310) that is longer than a distance between the bearings 460 and 470.

The mounting member 498 is secured to the bottom of the storage space 491*a* in the case body 420. The mounting member 498 has two mounting holes 498*a* and 498*b* both formed therein. Each mounting hole has a square section in order that knob 410 may be mounted therein. A magnet 440 is mounted on the central underside of the mounting member 498 and located on the bottom of the storage space 491*b*. The metal member 340 of the cutter 300 is attracted upward by the magnetic force of the magnet 440. The magnet 440 attracts the cutter 300 thereby to hold the cutter 300. The magnet 440 is disposed on an extension extending from the metal member 340 in the direction of the central axis L1 (see FIG. 5). Accordingly, when inserted into the cutting member 400 form below, the cutter 300 is attracted upward by the magnetic force of the magnet 440. The cutter 300 is then held at a position where the stepped portion between the shaft 320 and the larger-diameter portion 350 is engaged with and locked to an end surface of the bearing 470. In this case, the cutter 300 is held so as to be prevented, from movement along the direction of the central axis L1. A support 492 includes the magnet 440 and the bearings 460 and 470.

The case body 420 has a male thread 443 formed on the outer circumference thereof. The male thread 448 is brought into mesh engagement with a female thread 449 of the cap 430. The female thread 449 is formed in the inner circumference of the larger-diameter portion 431 of the cap 430. The cap 430 is combined with the case body 420 as the result of threading engagement of the threads 448 and 449. In this case, the cap 430 is combined with the case body 420 so that the position thereof in the direction of the central axis L1 is adjustable.

The smaller-diameter portion 432 of the cap 430 has an underside 440*a* which is formed into a circular horizontal flat surface. The underside 440*a* of the smaller-diameter 432 is brought into face-to-face contact with the object 160. The underside 440*a* is formed with a hole 440*b* through which the blade 330 of the cutter 300 is passable. The cap 430 is assembled to the case body 420 so as to be substantially prevented from backlash at least in a radial direction.

A compression coil spring 497 mounted on a lower part of the case body 420 is enclosed in the larger-diameter portion 431. Thus, the cap 430 is normally biased downward by the compression, coil spring 497. Accordingly, the threads 448 and 449 engaged with each other are prevented from backlash with the result that an amount of projection of the blade 330 can be adjusted precisely. A small protrusion 496 is formed on the lower part of the case body 420 so as to be located at the stepped portion 495 side. The protrusion 496 is engaged with and locked to an upper end of the spring 497. Accordingly, the spring 497 can be prevented from detachment from the case body 420 even when the cap 430 is detached from the case body 420 during replacement of the cutter 300 or the like.

The cutter 300 is held in the case body 420 by the magnetic attractive force of the magnet 440 and the stepped portion between the shaft 320 and the larger-diameter portion 350 thereof. In this case, the cutter 300 is held so as to be pulled upward and so as to be prevented from upward movement. Accordingly, when replacing the cutter 300, the user can easily detach the cutter 300 from the case body 420 only by pulling the cutter 300 downward against the magnetic attractive force of the magnet 440.

The Cutter 300

Figure 7:
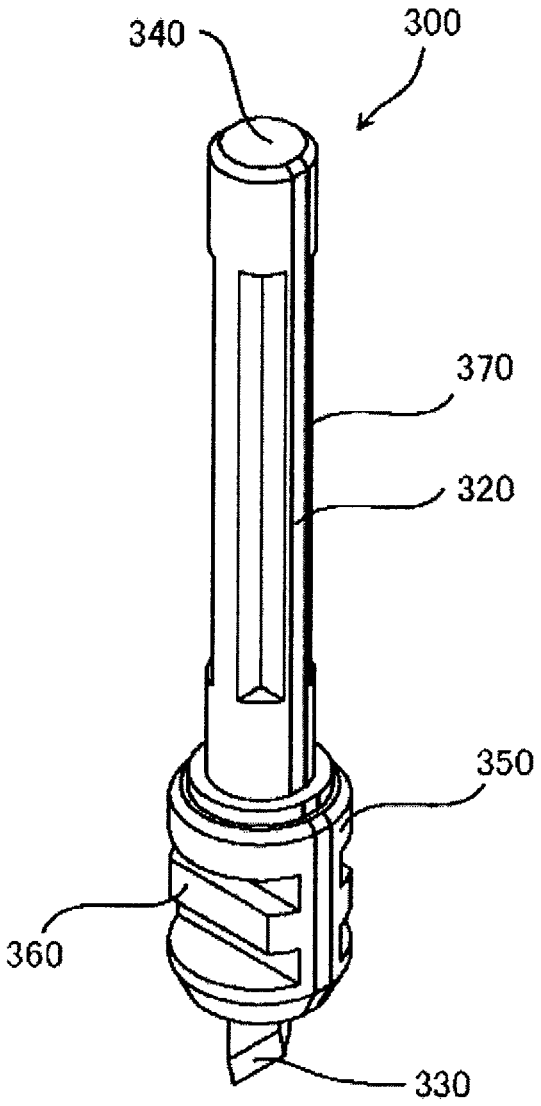
FIG. 7 is a perspective view of a cutter.
Figure 8:
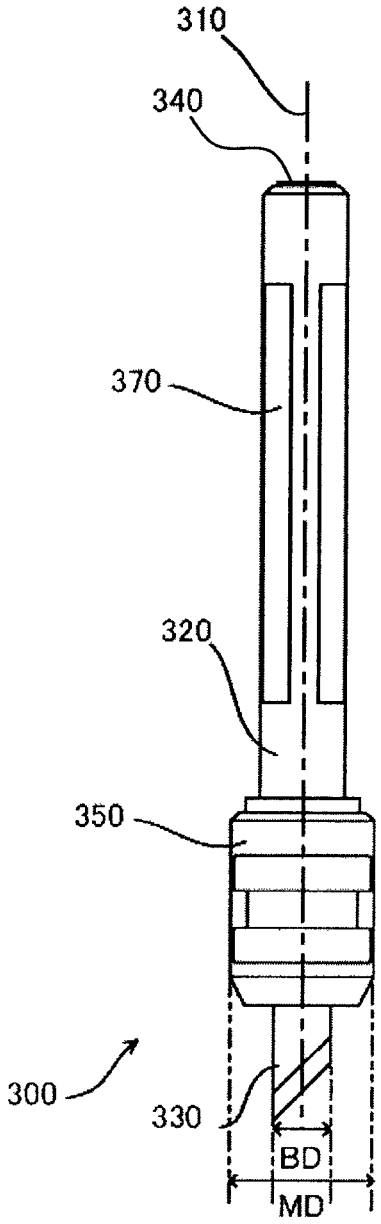
FIG. 8 is a side elevation of the cutter.

The construction of the cutter 300 will foe described with reference to FIGS. 7 and 8. The cutter 300 includes the shaft 320, the blade 330 and the metal member 340. The shaft 320 is formed into the shape of a round bar and extends in the direction of the axis 310. The shaft 320 includes an upper part and a lower part both of which serve as supporting portions as will be described later. The upper and lower portions of the shaft 320 have sections which are circular, more specifically, a section which is taken in the direction perpendicular to the axis 310 and is circular. The shaft 320 is formed of a resin such as ABS resin. However, the shaft 320 may be formed of another resin. The shaft 320 is supported by the supporting member 402. More specifically, the shaft 320 has two support portions which are supported by the bearings 460 and 470 so as to be rotatable.

The shaft 320 includes the larger-diameter portion 350 and a smaller-diameter portion 370. The larger-diameter portion 350 is formed into a substantially columnar shape and has a larger outer diameter than the smaller-diameter portion 370. More specifically, the outer diameter MD of the larger-diameter 350 is larger than a width BD of the blade 330 as shown in FIG. 3. When the metal member 340 is attracted by the magnet 440, the larger-diameter portion 350 abuts on the end surfaces of the bearings 460 and 470 thereby to be locked so as to be immovable in the direction of the axis 310. The larger-diameter portion 350 has a concavo-convex portion 360 formed in the central part thereof in the up-down direction. The concavo-convex portion 360 includes an axially central part having a smaller outer diameter than both axial ends of the concavo-convex portion 360. When pinching the concavo-convex portion 360 with his/her fingers, the user can handle the cutter 300 in safety without touching the blade 330.

The smaller-diameter portion 370 is located at the metal member 340 side in the direction of the axis 310. The smaller-diameter portion 370 is formed into a generally columnar shape and has an outer diameter which is substantially equal to inner diameters of the bearings 460 and 470. The smaller-diameter portion 370 is rotatably supported by the bearings 460 and 470 with the axis 310 serving as the center thereof.

The blade 330 is provided on a first one or both axial ends of the shaft 320, which first end is a distal end of the larger-diameter portion 350. The blade 330 is a flat blade comprising a flat metal plate. The blade 330 is embedded in the first end of the shaft 320. The blade 330 has a distal end which is inclined relative to the object 160 and formed into a generally triangular shape and is provided for cutting the object 160. The axis 310 passes a thicknesswise and widthwise centers of the blade 330. A blade part is provided on the first end which is further away from the shaft 320 than the other end of the blade 330.

The metal member 340 is provided on a second one of the axial ends of the shaft 320, which second end is a distal end of the smaller-diameter portion 370. The second end is located opposite the first end. The metal member 340 is made of a magnetic material and is a metal flat plate which can be attracted by the magnet 440. The metal member 340 is embedded in the upper end of the shaft 320. The metal member 340 may be molded from a resin containing magnetic powder.

Method of Manufacturing the Cutter 300

Figure 9:
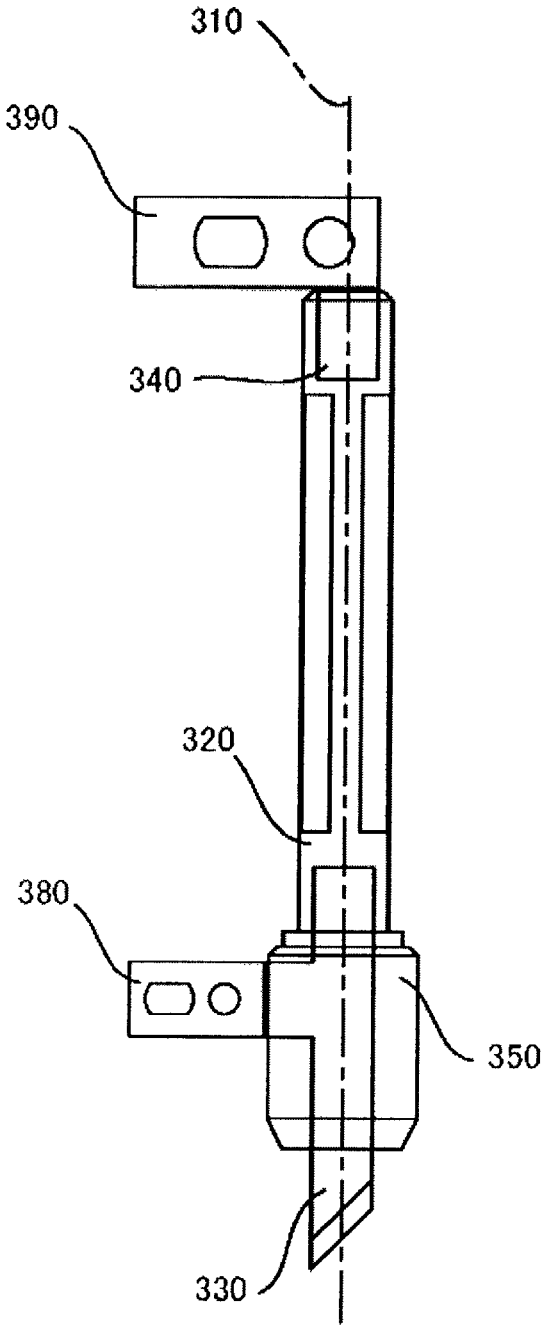
FIG. 9 is a sectional view of the cutter including first and second plates.

A method of manufacturing the cutter 300 will be exemplified with reference to FIG. 9. The manufacturing method should not be limited to this example. The blade 330 and the metal member 340 are made of the same metal plate in the example.

Firstly, a metal plate is pressed to be formed into a laterally-facing T-shaped first plate 380 and an inverted L-shaped second plate 390. The metal plate has a plate thickness of 0.5 mm, for example.

A lower end of the first plate 330 is sharpened at a next process. The first and second plates 380 and 390 are set in a metal die of an injection machine (not shown) at a further next process. The shaft 320 is insert-molded between the first and second plates 380 and 390. In this case, if the first and second plates 380 and 390 are a single combined plate member, there is a possibility that resin injection pressure would deform the plate member during the insert molding. When the plate member is deformed, the molded shaft 320 (the axis 310) would bend. In the example, however, adverse effects of the resin injection pressure can be avoided since two separated first and second plates 380 and 390 are used. Accordingly, the shaft 320 and accordingly, the entire cutter 300 can be manufactured with desirable precision. Furthermore, the cutter 300 can be manufactured at lower costs as compared with the case where a whole cutter is cut out of a metal bar material.

Subsequently, the first plate 380 has an excess part extending from the larger-diameter portion 350 in the direction perpendicular to the axis 310. The excess part of the first plate 380 is cut. Thus, the blade 330 is made of the first plate 380.

Furthermore, the second plate 390 has an excess part extending from an end of the shaft 320 located opposite the blade 330. The excess part of the second plate 390 is cut. Thus, the metal member 340 is made of the second plate 390.

Advantageous Effect

The shaft 320 of the cutter 300 comprises the resin in the above-described example. Accordingly, the cutter 300 can be manufactured at lower costs as compared with the case where the cutter is cut out of a metal bar material. Furthermore, since the metal member is located at the second end of the shaft 320, the cutter 300 is attracted by the magnet 440 provided on the support member 402 supporting the cutter 300. Consequently, the cutter 300 can be easily attached and detached. The cutter 300 is held with the bearing in abutment on the smaller-diameter portion 370 of the shaft 320, whereby the cutter 300 can be supported so as to be rotatable about the axis. Furthermore, when the metal member 340 is attracted by the magnet 440, the stepped portion (the proximal end surface of the large-diameter portion 350) formed between the larger-diameter portion 350 and the smaller-diameter portion 370 abuts on the end surface of the bearing. As a result, the cutter 300 can be rendered immovable in the axial direction, whereby the cutter 300 is locked in the state where the axial position of the cutter 300 relative to support member 402 is immovable. Still furthermore, since the metal member 340 does not directly abut on the magnet 440, the cutter 300 can foe rotated about the axis more easily as compared with the case where the metal member directly abuts on the magnet.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutter which is detachably attachable to a support member, the cutter comprising:

a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by a plurality of bearings provided on the support member, the larger-diameter portion having a proximal end surface abutting on an end surface of one of the bearings, with a result that the cutter is locked in a state where an axial position of the cutter relative to the support member is immovable;

a flat blade provided on a first end which is a distal end of the larger-diameter portion, the flat blade cutting an object to be cut;

a metal member which can be attracted by a magnet provided on the support member, the metal member being provided on a second end which is a distal end of the smaller-diameter portion;

a plurality of contact portions provided on axially differing portions of the shaft respectively, the contact portions being capable of contacting the bearings respectively; and a plurality of thinned parts provided between the contact portions and extending in the axial direction of the shaft.

2. The cutter according to claim 1, wherein the larger-diameter portion has an outer diameter which is larger than a width of a cutting part of the flat blade.

3. The cutter according to claim 1, wherein the larger-diameter portion has an axially central part formed with a recess which is smaller than an outer diameter of the larger-diameter portion, and the recess is formed with a concavo-convex portion.

4. The cutter according to claim 2, wherein the larger-diameter portion has an axially central part formed with a recess which is smaller than the outer diameter of the larger-diameter portion, and the recess is formed with a concavo-convex portion.

5. The cutter according to claim 1, wherein the flat blade and the metal member provided on the second end of the smaller-diameter portion are made from an identical material.

6. A cutting member comprising:

a support member to which a cutter is detachably attached, thereby supporting the cutter, the support member having a plurality of bearings rotatably supporting the cutter and a magnet configured to position the cutter, the cutter including:

a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by the bearings provided on the support member, the larger-diameter portion having a proximal end surface abutting on an end surface of one of the bearings, with a result that the cutter is locked in a state where an axial position of the cutter relative to the support member is immovable;

a flat blade provided on a first end which is a distal end of the larger-diameter portion, the flat blade cutting an object to be cut;

a metal member which can be attracted by the magnet provided on the support member, the metal member being provided on a second end which is a distal end of the smaller-diameter portion;

a plurality of contact portions provided on axially differing portions of the shaft respectively, the contact portions being capable of contacting the bearings respectively; and a plurality of thinned parts provided between the contact portions and extending in the axial direction of the shaft.

7. The cutting member according to claim 6, wherein the larger-diameter portion has an outer diameter which is larger than a width of a cutting part of the flat blade.

8. The cutting member according to claim 6, wherein the larger-diameter portion has an axially central part formed with a recess which is smaller than an outer diameter of the larger-diameter portion, and the recess is formed with a concavo-convex portion.

9. The cutting member according to claim 7, wherein the larger-diameter portion has an axially central part formed with a recess which is smaller than the outer diameter of the larger-diameter portion, and the recess is formed with a concavo-convex portion.

10. The cutting member according to claim 6, wherein the flat blade and the metal member provided on the second end of the smaller-diameter portion are made from an identical material.

11. A cutting apparatus comprising:

an object transfer mechanism configured to transfer a holding member holding an object to be cut;

a cutter moving mechanism configured to move a cutting head provided with a holder in a direction intersecting a direction in which the holding member is transferred;

a cutting member attached to the holder, the cutting member including:

a support member to which a cutter is detachably attached, thereby supporting the cutter, the support member having a plurality of bearings rotatably supporting the cutter and a magnet configured to position the cutter, the cutter including:

a shaft made of a resin and having a smaller-diameter portion and a larger-diameter portion with a larger diameter than the smaller-diameter portion, the smaller-diameter portion and the larger-diameter portion being formed integrally with the shaft, the smaller-diameter portion being rotatably supported by the bearings provided on the support member, the larger-diameter portion having a proximal end surface abutting on an end surface of one of the bearings, with a result that the cutter is locked in a state where an axial position of the cutter relative to the support member is immovable;

a flat blade provided on a first end which is a distal end of the larger-diameter portion, the flat blade cutting an object to be cut;

a metal member which can be attracted by the magnet provided on the support member, the metal member being provided on a second end which is a distal end of the smaller-diameter portion;

a plurality of contact portions provided on axially differing portions of the shaft respectively, the contact portions being capable of contacting the bearings respectively; and a plurality of thinned parts provided between the contact portions and extending in the axial direction of the shaft.

12. The cutting apparatus according to claim 11, wherein the larger-diameter portion has an outer diameter which is larger than a width of a cutting part of the flat blade.

13. The cutting apparatus according to claim 11, wherein the larger-diameter portion has an axially central part formed with a recess which is smaller than an outer diameter of the larger-diameter portion, and the recess is formed with a concavo-convex portion.

14. The cutting apparatus according to claim 12, wherein the larger-diameter portion has an axially central part formed with a recess which is smaller than the outer diameter of the larger-diameter portion, and the recess is formed with a concavo-convex portion.

15. The cutting apparatus according to claim 11, wherein the flat blade and the metal member provided on the second end of the smaller-diameter portion are made from an identical material.

* * * * *